US008585462B2

(12) United States Patent
Jensen et al.

(10) Patent No.: US 8,585,462 B2
(45) Date of Patent: Nov. 19, 2013

(54) PRECISION SHARPENER FOR CERAMIC KNIFE BLADES

(71) Applicant: Edgecraft Corporation, Avondale, PA (US)

(72) Inventors: George C. Jensen, Bear, DE (US); Daniel D. Friel, Jr., Kennett Square, PA (US); Samuel Weiner, Wilmington, DE (US)

(73) Assignee: Edgecraft Corp., Avondale, PA (US)

( * ) Notice: Subject to any disclaimer, the term of this patent is extended or adjusted under 35 U.S.C. 154(b) by 0 days.

(21) Appl. No.: 13/719,595

(22) Filed: Dec. 19, 2012

(65) Prior Publication Data

US 2013/0165021 A1 Jun. 27, 2013

Related U.S. Application Data

(60) Provisional application No. 61/578,954, filed on Dec. 22, 2011.

(51) Int. Cl.
*B24B 9/06* (2006.01)
*B24B 3/54* (2006.01)

(52) U.S. Cl.
USPC ..... 451/41; 451/45; 451/349

(58) Field of Classification Search
USPC ..... 451/45, 259, 262, 267, 349; 76/81, 76/81.7, 81.8, 82, 86, 87, 88
See application file for complete search history.

(56) References Cited

U.S. PATENT DOCUMENTS 4,627,194 A 12/1986 Friel
4,716,689 A 1/1988 Friel
4,807,399 A 2/1989 Friel
D303,209 S 9/1989 Friel
D310,620 S 9/1990 Friel
5,005,319 A 4/1991 Friel
D328,410 S 8/1992 Friel
5,148,634 A 9/1992 Bigliano
5,245,791 A 9/1993 Bigliano
5,390,445 A 2/1995 Giovanazzi
5,611,726 A 3/1997 Friel
D409,891 S 5/1999 Friel
6,012,971 A * 1/2000 Friel et al. ..... 451/45
6,071,181 A * 6/2000 Wightman et al. ..... 451/192
6,113,476 A 9/2000 Friel
6,267,652 B1 7/2001 Friel
6,863,600 B2 3/2005 Friel
6,875,093 B2 4/2005 Friel (Continued)

OTHER PUBLICATIONS

International Search Report for PCT/US2012/070779, mailing date Mar. 8, 2013.

*Primary Examiner* — Robert Rose
(74) *Attorney, Agent, or Firm* — Novak Druce Connolly Bove + Quigg LLP

(57) ABSTRACT

An electrically powered knife sharpener for ceramic (or other brittle, crystalline or amorphous media which could be used for blades) knives includes at least one pre-sharpening stage with a sharpening member(s) and includes a final stage with a sharpening member(s). There are one or more motor driven shafts on which the abrasive surfaced sharpening members, such as disks, are mounted. Guide structure is provided to guide the knife for aligning and positioning the knife facet precisely at a defined location on the abrasive surface of each rotating sharpening member. The pre-sharpening stage sharpening member(s) moves in a first direction. The final stage sharpening member(s) moves in a second direction which differs from the first direction.

35 Claims, 9 Drawing Sheets

(56) References Cited

U.S. PATENT DOCUMENTS

| | | | | |
|---|---|---|---|---|
| 6,881,137 | B2 | 4/2005 | Friel | |
| 6,997,795 | B2 | 2/2006 | Friel | |
| 7,121,923 | B1 | 10/2006 | Sweet | |
| 7,198,558 | B2 * | 4/2007 | Levsen | 451/263 |
| D542,616 | S | 5/2007 | Elek | |
| D543,430 | S | 5/2007 | Barr | |
| 7,235,004 | B2 | 6/2007 | Friel | |
| 7,287,445 | B2 | 10/2007 | Friel | |
| D567,611 | S | 4/2008 | Elek | |
| 7,452,262 | B2 | 11/2008 | Friel | |
| 7,488,241 | B2 | 2/2009 | Elek et al. | |
| 7,494,403 | B2 | 2/2009 | Friel | |
| 7,517,275 | B2 | 4/2009 | Friel | |
| 7,686,676 | B2 | 3/2010 | Friel | |
| 7,722,443 | B2 * | 5/2010 | Levsen | 451/262 |
| 7,740,522 | B2 * | 6/2010 | Walker | 451/45 |
| D620,332 | S | 7/2010 | Elek | |
| 8,043,143 | B2 | 10/2011 | Elek | |
| D651,887 | S | 1/2012 | Elek | |
| D652,284 | S | 1/2012 | Elek | |
| D665,647 | S | 8/2012 | Friel | |
| 8,267,750 | B2 | 9/2012 | Friel | |
| 2009/0233530 | A1 * | 9/2009 | Friel et al. | 451/45 |
| 2011/0034111 | A1 * | 2/2011 | Elek et al. | 451/45 |

* cited by examiner

STAGES 1 and 2

STAGE 3

MOTOR / TRANSMISSION MECHANISM VARIATION

PRECISION SHARPENER FOR CERAMIC KNIFE BLADES

CROSS REFERENCE TO RELATED APPLICATION

This application is based upon provisional application Ser. No. 61/578,954, filed Dec. 22, 2011, all of the details of which are incorporated herein by reference thereto.

BACKGROUND OF THE INVENTION

Ceramic knives, imported in increasing numbers during the past 20, years, have attracted much attention in the United States and Europe because of their initial sharpness and durability especially when their use is confined to relatively soft and tender foods. Major drawbacks to their wider use are their tendency to break if dropped on hard surfaces and the lack of a good, convenient and inexpensive sharpener to restore their edge when they become chipped from use.

Several leading manufacturers of ceramic knives have urged users to return chipped blades to their factories in Japan for restoration. One manufacturer went as far as to install sharpening stations in retail outlets as a solution to the sharpening problem but the inconvenience of either means has hindered widespread use of ceramic knives and none of the sharpening stations has demonstrated that it can restore blades to their original factory quality.

Available information suggests that the Asian blade factories sharpen their ceramic blades depending on skilled artisans who place the blade edges in contact with the disks and as a result, the blade edge quality relies heavily on their dexterity, expensive equipment and skill.

Ceramic knife sharpeners supplied by one Asian manufacturer to retail shops to sharpen their ceramic blades was based on extremely high speed disks, using messy liquid abrasive mixtures. Their performance was very inconsistent and customers were dissatisfied with the results.

Even the most recent retail sharpeners offered by the ceramic knife manufacturers do little more than remove major chips from the edge. A battery powered offering uses conventional steel blade sharpening disks and creates a relatively dull edge far inferior to a typical factory edge. Prior to the sharpener described in this application there has not been a ceramic knife sharpener available to the public that can create a factory quality edge on such knives. In fact all sharpeners which have been available created only poor or inconsistent edges.

The present inventors evaluated whether any of the advanced commercially available sharpeners designed for metallic knives could sharpen ceramic knives, only to find they badly chipped the edge of ceramic knives. All such sharpeners tested were totally unusable to produce useful edges on ceramic blades.

SUMMARY OF INVENTION

An object of this invention is to provide novel and inexpensive techniques of sharpening ceramic knife blades in the home with a precision equal that to the highest quality Asian factories.

In accordance with one practice of this invention an electrically powered knife sharpener comprises at least one motor driven shaft on which is mounted one or more abrasive surfaced disks. Guiding structure guides and stabilizes the knife to align and position the knife facet precisely at a defined location on the abrasive surface of each rotating disk. The orientation of the knife blade relative to the surface of the rotating disks or other abrasive sharpening member, provides at the points of defined location at least one disk surface abrasives moving in the direction into the edge and across the supporting edge facet and provides at least one disk surface moving in the opposite direction across the supporting edge facet and then out of the edge itself.

The invention can be practiced for sharpening the cutting edge of a cutting instrument wherein the edge of the blade is made of a hard and brittle material of which ceramic is one example.

Various types of sharpening members can be used instead of disks, such as drums or belts.

Various preferred abrasive grit sizes are disclosed as well as preferred linear speeds of the abrasives.

The invention can be practiced where the sharpening members of the pre-sharpening stages move in one direction and the sharpening members in the final stage move in a different direction. Preferably, the directions are completely opposite each other although the invention can be practiced with less changes of direction. Different transmission mechanisms can be used to impart the different directions to the pre-sharpening members as compared to the final sharpening members. In one variation the sharpening members in the pre-sharpening stages are mounted on a first shaft to move in one direction while the sharpening members in the final stage are mounted on a displaced, parallel second shaft with the transmission mechanism being a gear train between the shafts. Preferably the gears are helical gears. Alternative transmission mechanisms can be a twisted belt and pulleys or a planetary transmission. A further variation would be to drive each shaft by separate motors or to mount all of the sharpening members on the same shaft and control the direction through use of a reversible variable speed motor.

THE DRAWINGS

DETAILED DESCRIPTION

Figure 1:
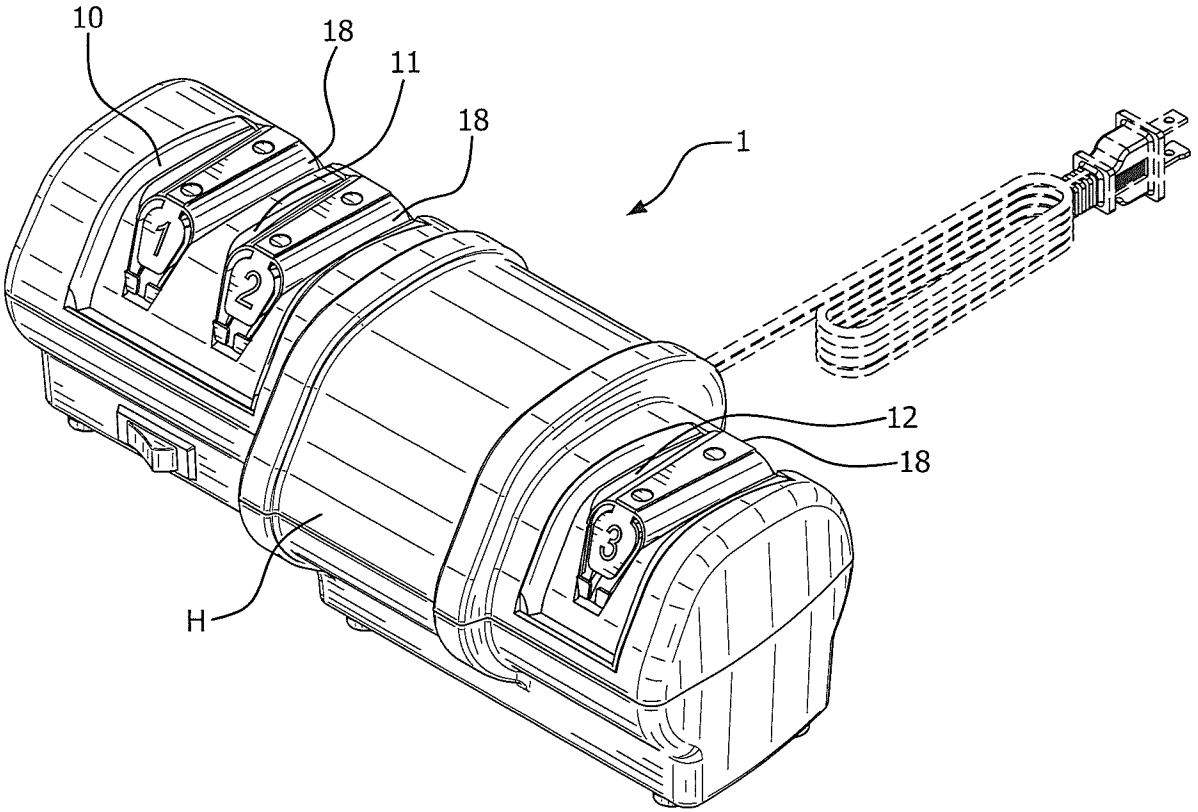
FIG. 1 is a perspective view of a knife sharpener in accordance with this invention.

What the present inventors have discovered is that even the most advanced technology used successfully in the past to sharpen metallic knives was counterproductive for ceramic knives or cutting instruments made of other hard, brittle, crystalline or amorphous media.

Ceramic knives are formed from ceramic powders such as zirconium oxide and zirconium carbide which are heated to a high temperature appropriate to fuse the powders into knife shapes. The resulting structure is cured for periods of days to add strength to the resulting blades. The bonding of the granular particles is good—leaving a strong material but one that is brittle and unlike steel knives lacks any ductility or flexibility. As a consequence we found the process of sharpening of a ceramic knife must be handled entirely differently from that used successfully with steel knives. The flexibility and ductility of a steel knife allows its very thin edge to bend and distort as it is sharpened and polished vigorously. That ductility allows the steel edge at its extreme tip to bend away from the abrading surface and form a burr which hangs onto the edge in the shape of a microscopic sized hook. That burr must be removed carefully to leave an extremely sharp edge on a steel blade.

Because of its brittleness, the edge of a ceramic blade will not form a burr, instead the edge geometry must be created by chipping, ablating or fracturing process over the entire facets that create the edge—all the way to their terminus.

The inventors have found that the geometry of the facets that form the edge can be initially established reasonably well and relatively quickly by a unique chipping action or fracturing. The inventors have demonstrated that single bonded diamond particles supported on rigid disks and traveling at sufficient speed can successfully chip the ceramic facet surfaces. Diamonds, the hardest material known to man, is hard enough to abrade zirconium oxide or carbide knives but the forces required to abrade are sufficiently large that the fine edge being formed fractures away seriously before it becomes very sharp unlike a fine steel edge that can bend away from those forces.

Commonly the sharpest steel edges are formed by moving the abrasive across the edge facets of a steel blade in a direction from the steel knife body across the facet and on to its edge, then into space. That motion puts the extreme tip of a steel edge under tension, extending it slightly but forcing it away from the facet and bending it into a wire burr as described above.

What the inventors discovered surprisingly is that the brittleness and lack of tensile strength of the ceramic knives results in repetitive and severe edge damage to the edge when the dry abrasives, for example diamonds, move across the facet and exit the facet at the edge itself. Then surprisingly the inventors found if they drive the abrasive in a direction first into the edge terminus and then across the surface of the knife edge facet, the delicate ceramic edge is put under compression (not tension) by the moving diamond particles and the ablating process resulted in superior, sharper edge geometry. With this discovery the inventors were able to produce a partially sharpened edge, but an edge that must be sharpened further by a secondary and different process to create a final edge of factory quality. In these experiments conically surfaced metal disks were used, these were covered with single diamonds bonded securely onto the metal disk substrates by an electroplating process. The diamonds were driven in the direction first into the edge, then across its supporting facet.

Sharpening experiments on ceramic knives were conducted using a variety of abrasives considered to be harder than ceramic knives commonly made of zirconium carbide and zirconium oxide. These abrasives included diamonds, boron carbide, silicon carbide, and aluminum oxide. Other abrasives that could be considered are tungsten carbide, titanium nitride, tantalium carbide, beryllium carbide, titanium carbide. Any material harder than zirconia or zirconium carbide can be used as an abrasive.

It is the intent of this application to describe a practical precision sharpener designed to be used for ceramic knives (as well as other blades of various cutting instruments composed of other sufficiently hard, brittle, crystalline or amorphous material) in the home by the unskilled homemaker. Consequently it has to be compact, user friendly, and affordable. It should, for practical reasons, not depend on liquid for cooling, lubrication or dispersion of abrasives when sharpening. The handling of liquids in any form would as a minimum prove difficult, if not impractical, in the home environment.

Prototype sharpeners for ceramic knives were built to incorporate and demonstrate what we have discovered and consider to be unique using novel methodology developed for chipping, ablating and micromachining as described herein. This made it possible to realize the sharpness and perfection of the best factory-made Asian ceramic knives.

Figure 2:
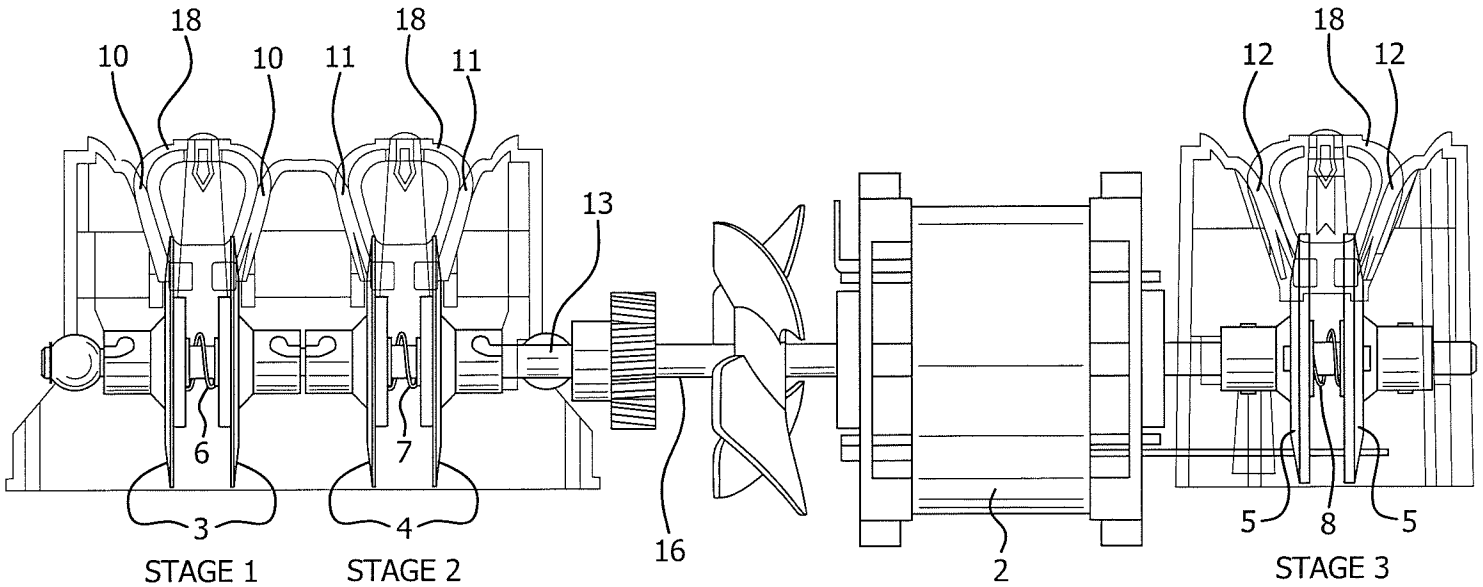
FIG. 2 is a side elevational view of the sharpener shown in FIG. 1.

FIG. 1 illustrates a sharpener 1 in accordance with this invention. As shown therein, sharpener 1 includes an outer housing H in which the working elements of the sharpener are enclosed. As illustrated in FIG. 1 housing H includes three stages indicated as Stage 1,, Stage 2, and Stage 3. Stages 1, and 2, are preliminary stages while Stage 3, is the final stage. Guide structure 10 is provided for Stage 1. Guide structure 11 is provided for Stage 2 and guide structure 12 is provided for Stage 3. This guide structure may take any suitable form, such as being a slot in the housing H presenting a planar surface against which a blade would be placed. As shown in FIG. 2 a pair of guide structures is provided for each stage. An inverted U-shaped plastic spring guide 18 is provided between each set of respective guide surface 10,10 and 11,11 and 12,12. The spring guide 18 has arms that provide a spring surface urged toward its corresponding guide surface 10, 11 or 12. As a result, when a blade is placed against the respective guide surface the spring guide arm urges the blade into intimate contact with the guide surface to stabilize the blade during its sharpening operation. This arrangement keeps the sharpener stable. Because of the spring tension the blade does not have the ability to move. Vibration is limited.

A reliable but inexpensive two pole shaded pole motor 2 operated at the conventional 120, volts AC was selected to drive a series of three (3) sets of specialized truncated conical shaped disks or sharpening members. The surface of the first two sets of these disks 3 and 4 in the pre-sharpening stages are coated with appropriate super hard abrasive-like particles such as diamonds, alumina, or silicon carbide that can efficiently remove the ceramic materials from the blade and create relatively quickly a reasonably good ceramic knife edge. The principles used in this example are equally applicable for sharpeners of widely different external cosmetic designs. The shape of these disks approximate truncated cones but the shape of the abrasive sharpening member can be altered without deviating from the intent of this design.

Selection of the optimum size of the chipping and ablating particles depends on several related parameters—particularly on the hardness of the abrasive, the particle velocity and the force applied (commonly by springs 6 and 7) in Stages 1, and 2. The optimum combination must also be determined with practical regard for the time it takes with a given combination to obtain an edge of sufficient sharpness before proceeding to the subsequent stage. Stages 1, and 2, are very similar in design but they must sequentially prepare an edge of sufficient quality that it can be given a final finishing (which could be polishing or lapping) in a reasonable time in final Stage 3. Stage 3, as described later is of an entirely different design than Stages 1, and 2, as necessary to complete the creation of a factory quality edge.

While other ablating and chipping materials (referred to here as "abrasives") were evaluated and can be used, in Stages 1, and 2, of this prototype, diamonds were selected. The supporting disks used in both stages were approximately 2, inches in diameter and the point of contact between the disk and the knife facet when sharpening was rotating at a radius of about ¾, inch. Tests were made of edge formation over a wide range of disk speeds (RPM) and with a variety of grit size and crystalline structure. While higher and lower RPM produced a reasonably good edge, the preferred speed that gave satisfactory edge in a reasonable time was in the range of 700, to 4000 RPM which is about 275, to 1570, feet/minute average particle velocity at the location of edge formation. The spring forces found best in Stages 1, and 2, with this speed and velocity range varied from 0.1, to 1.0, pound, with the preferred force being less than 0.6, pound. Spring forces greater than 0.6, pound resulted in more irregularities along the edge and reduced edge sharpness. Size of the diamond crystals during these tests of Stages 1, and 2, varied from 600, to 2000, grit. Satisfactory results were obtained within this range but the greater the particle size, the more dependent the edge condition was on rotational speed.

Figure 4:
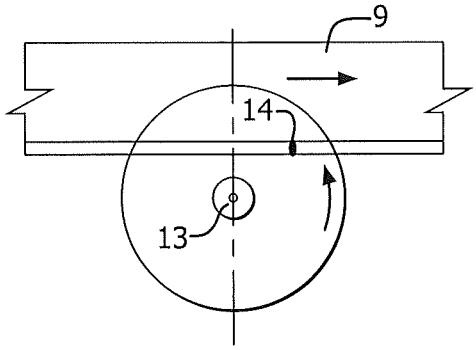
FIG. 4 is an end elevational view showing a sharpening member and a knife from Stages 1, and 2, in the sharpener of FIGS. 1-3.
Figure 5:
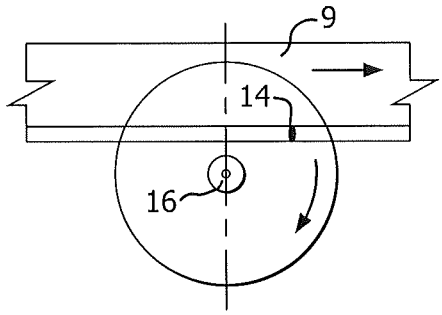
FIG. 5 is a view similar to FIG. 4 showing the sharpening member in the third stage.

Pre-sharpening the ceramic blade in Stage 1, requires a relatively larger grit in order to remove promptly any large chips that may exist along its edge. Stage 2, contains a finer grit to create a sharper edge. Both of these stages are designed to rotate in that same direction (See FIG. 4) that drives the ablating "abrasive" into the knife edge rather than first across the edge facet and then exit out of the edge. Looking at FIG. 2 the forward circumference rim of those disks in Stages 1, and 2, are rotating upward and the knife guides 10 and 11 are towed in precisely so that the knife facet and edge contacts the rotating disk at a point on each disk forward (toward the viewer) of the motor shaft and in the upper front quadrant as shown in FIG. 4. At that location on the disk the "abrasive" particles are moving up "into" knife edge. The plane of the knife facet will be approximately parallel to the rotating disk surface at that point of contact. FIG. 4 shows the relative motion of the knife 9, the facet contact point 14 and the preferred direction of disks 3 and 4. FIG. 5 shows an opposite direction of movement in Stage 3.

Experiments and testing indicate that the approach angle of the abrasive particles is less critical so long as the abrasive particles are driven in such a way to compress the blade material in pre-sharpening stages. The approach angle could be nearly parallel to the edge facet or could be nearly perpendicular to the edge facet. The approach angle of abrasive particles at point of contact can be at any angle between 10, to 90, degrees relative to the blade facet with a preferred angle of 90, degrees. To be clear the approach or departure angle is not the facet angle. Previous art of precise abrasive facet angle control can be used for blades composed of ceramic or other suitably hard brittle, crystalline or amorphous material.

Figure 7:
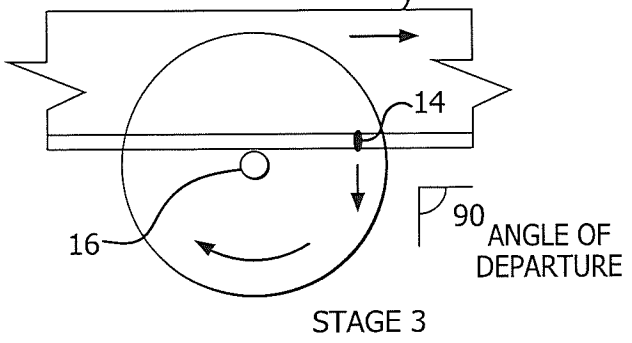
FIG. 7 is an end elevational view illustrating an angle of departure of the sharpener shown in FIGS. 1-3.
Figure 6:
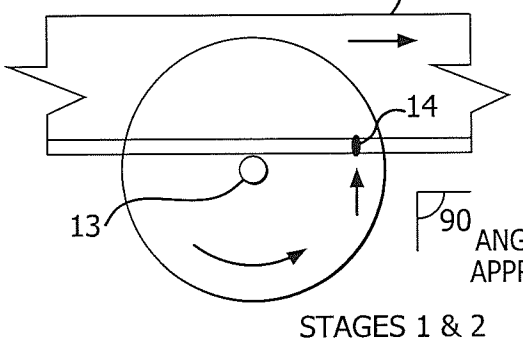
FIG. 6 is an end elevational view illustrating an angle of approach in Stages 1-2, of the sharpener of FIGS. 1-3.
Figure 9:
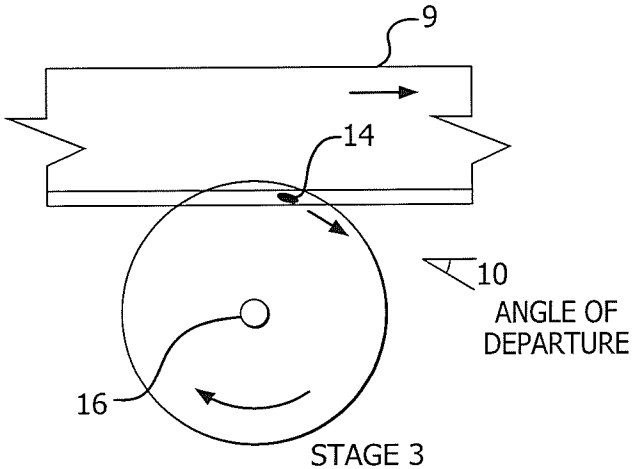
FIG. 9 is an end elevational view similar to FIG. 7 showing a different angle of departure.
Figure 8:
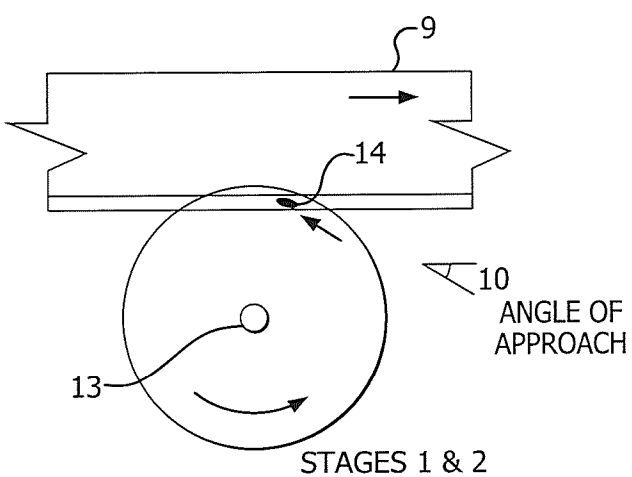
FIG. 8 is an end elevational view similar to FIG. 6 showing a different angle of approach.

FIGS. 6 and 7 illustrate a variation of the angle of approach for Stages 1, and 2, and the angle of departure for Stage 3, where the angle of approach for Stages 1, and 2, and the angle of departure for Stage 3, is 90, degrees. FIGS. 8-9 show a variation where the angle of approach for Stages 1 and 2, and the angle of departure for Stage 3, is 10, degrees. As illustrated the direction of movement for the sharpening member in Stages 1, and 2, in each variation is opposite or differs from the direction of movement in the third Stage.

The detailed design of Stage 1, considered a unique combination of effective "abrasive" particles of optimized size and crystalline structure, suitable particle velocity (disk size and RPM), and a carefully determined abrasive force against the blade edge (e.g. spring 6) is used to establish and limit the abrasive force of contact between the abrasive and blade facet. Other forms of force could be used to establish and limit the abrasive force such as foam, tensioned plastic components, and other resilient materials. This stage must be sufficiently aggressive to remove all major nicks from the edge and leave an edge of sufficient refinement for Stage 2.

Figure 3:
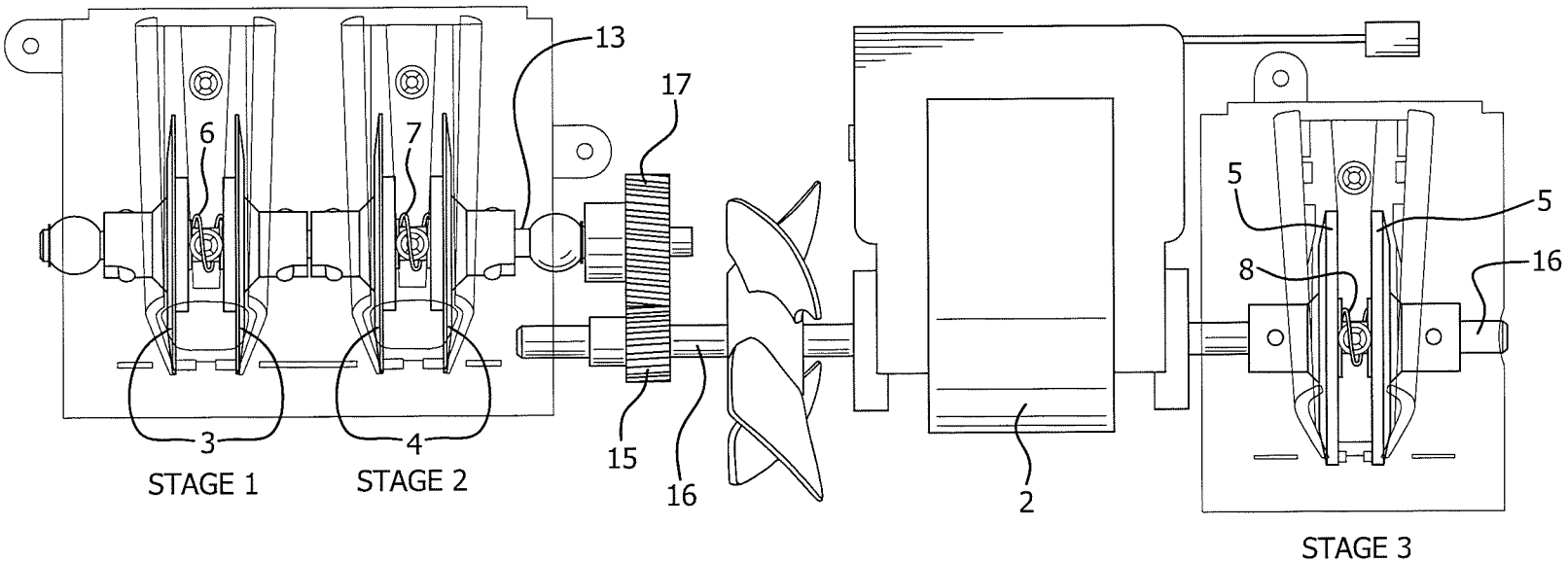
FIG. 3 is a top plan view of the sharpener shown in FIGS. 1-2.

The purpose of Stage 2, is to refine the edge created in Stage 1, sufficiently that the much more sophisticated finishing of final Stage 3, will be able in reasonable time refine the edge to factory quality. In considering the design of Stage 2, it is convenient for purposes of design and construction to drive the disks 4,4 of Stage 2, at the same RPM as Stage 1. FIGS. 2-3 illustrate both Stages 1, and 2, driven off the same shaft 13 and at the same speed. As later described the technology of Stage 3, is quite different from these first two stages and as a result its requirements regarding particle direction, speed, etc. are best considered separately for optimal edge finishing.

For Stage 2, the major change needed beyond Stage 1, is to use a slightly finer particle size. Because the resulting edge created in Stage 2, will be sharper and its width smaller, it is optimal to use a slightly lower spring force for spring 7 than in Stage 1. The best results are believed to be obtained with spring force in the range of 0.2, to 0.5, pounds. The best particle size is also lower, with grits as fine as 2000, grit.

Stage 3, represented the greatest challenge. Surprisingly the inventors found it is impossible to create a factory quality edge using the technology of Stages 1, and 2. Finishing to the factory level could not be achieved with particles of diamond using the rigid metal backed disks that performed well in the first two stages. Mechanical perfection of the sharpener and its drive was shown to be a serious requirement if rigid disks were used or as the speed increases. For optimum, desired results it proved critical for Stage 3, disks to imbed the "abrasive" particles within a soft plastic medium. The inventors found surprisingly that it is better to reverse or at least change the direction of the abrasive particles, to use higher abrasive speeds and to direct the abrasive laden wheel "out of the edge." (See FIG. 5) Further surprising was the fact that such a softer imbedding medium for the abrasive made it possible to use slightly larger silicon carbide that we could have used with rigid metal backing while realizing a superior edge quality. In other words the inventors were able to use larger abrasive particles than could have used successfully if metal backed disks were used. Silicone carbide abrasives about 15, micron in size were used in the two Stage 3, disks 5. Other combinations of disk durometers, particle size and spring constant can be used for the Stage 3, disks within the practice of this invention.

The inventors discovered that the plastic embedment in Stage 3, provides a slightly elastic and gentler impact of the particles against the ceramic knife edge facets and consequently the facets could be eroded and thinned with substantially less damage to the edge itself. The spring tension primarily used in Stage 3, from spring 8 was within the range of 0.6, to 1.24, pounds with a preferred force of 0.8, to 1.1, pounds. The edge thickness could be reduced to that size typical of the best Asian ceramic knives produced by skilled artisans. The abrasive speed in this configuration was found to be most efficient and effective at higher speeds than the pre-sharpening stages. The linear velocity was found to be effective in the range of 700, to 3500, feet per minute with the optimum being 1000, to 1500, feet per minute which corresponds to 3000, rpm and higher. The higher particle velocity is preferred for the final edge finishing in Stage 3.

Satisfactory plastic based disks for Stage 3, were compounded with special epoxy resins supplied by Masterbond (Hackensack, N.J.) composition EP37-3FLF. A ratio of 60% by weight of abrasive and 40% epoxy by weight was used for most of the experiments.

The physical characteristics of that material as determined on a modified Rockwell hardness test with a primary load of 60, Kg and a recovery load of 10, Kg with a ⅞, " diameter steel compressor ball was as follows:

| | Divisions | Divisions |
|---|---|---|
| 60 Kg Initial Depression | 235 | 235 |
| 10 Kg "Recovery" Depression | 85 | 90 |
| Difference | 150 Divisions | 145 |
| Recovery | | |
| $\frac{150}{235}$ % Recovery = | 64% | 61% |

In order to incorporate into one sharpener-housing the three disks with Stages 1, and 2, operating with the abrasive driven "into the edge" and with Stage 3, abrasive disk "driven out of the edge," also in need of higher abrasive velocity in Stage 3, in this prototype shown in FIG. 3, a set of helical transfer gears 17 and 15 was used to create approximately a 2, to 1, increase in the RPM of drive shaft 16 compared to shaft 13. The RPM in Stage 3, then was on the order of 3600. The disk diameter was about two inches. Although straight cut gears can be used instead of helical gears, helical gears are preferred for the ability to reduce noise and driveline lash.

FIG. 3 illustrates one embodiment of an electrically powered drive structure for moving the pre-sharpening members 3,4 in one direction and for moving the final sharpening members 5 in a different direction. As shown therein, motor 2 drives shaft 16 on which the final sharpening members or disks 5 are mounted. A transmission mechanism connects shaft 16 with shaft 13 on which the pre-sharpening members 3,4 are mounted. As illustrated the transmission mechanism is a helical gear 15 on shaft 16 which meshes with helical gear 17 on shaft 13. Other forms of motor/transmission mechanisms are illustrated in FIGS. 10-14.

Figure 10:
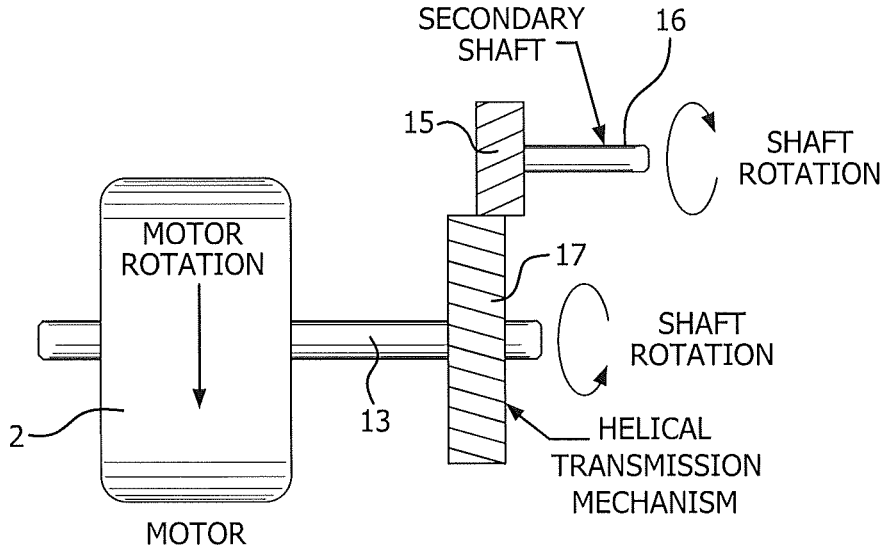
FIG. 10 is a top plan view schematically showing one form of transmission mechanism which could be used in the sharpener of FIGS. 1-3.

FIG. 10 illustrates a variation where motor 2 drives shaft 13. The sharpening members 4,5 in the pre-sharpening stages, Stage 1, and Stage 2,, would be mounted on shaft 13 to the left of motor 2. A helical gear 17 mounted on shaft 13 drives helical gear 15 which is mounted on shaft 16 for rotating shaft 16 in an opposite direction to shaft 13. Thus, the final sharpening members 5,5 which would be mounted to the right on shaft 16 would be rotated in a different direction than the pre-sharpening stage sharpening members. Shafts 13 and 16 are parallel and displaced from each other.

Figure 11:
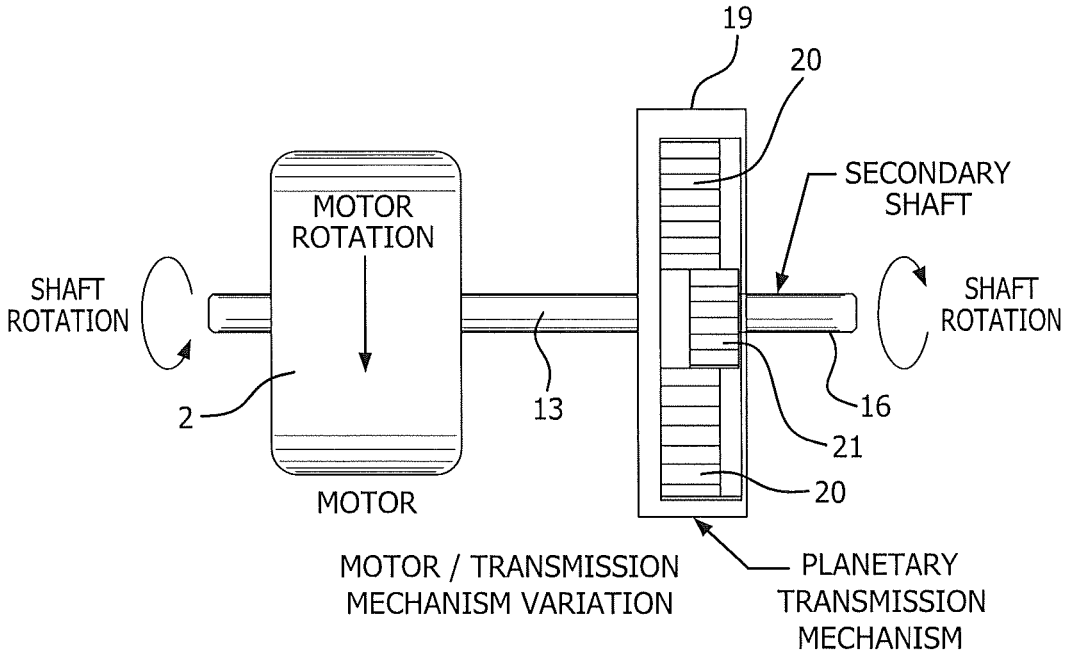
FIG. 11 is a view similar to FIG. 10 showing a variation of the transmission mechanism.

FIG. 11 shows yet another form of motor/transmission mechanism which utilizes a planetary transmission mechanism. As shown therein, motor 2 rotates shaft 13 attached to shell 19 in which gears 20,20 are mounted. Central gear 21 meshes with gears 20,20 to drive shaft 16. The various sharpening members would be mounted on their respective aligned shafts 13 and 16.

Figure 12:
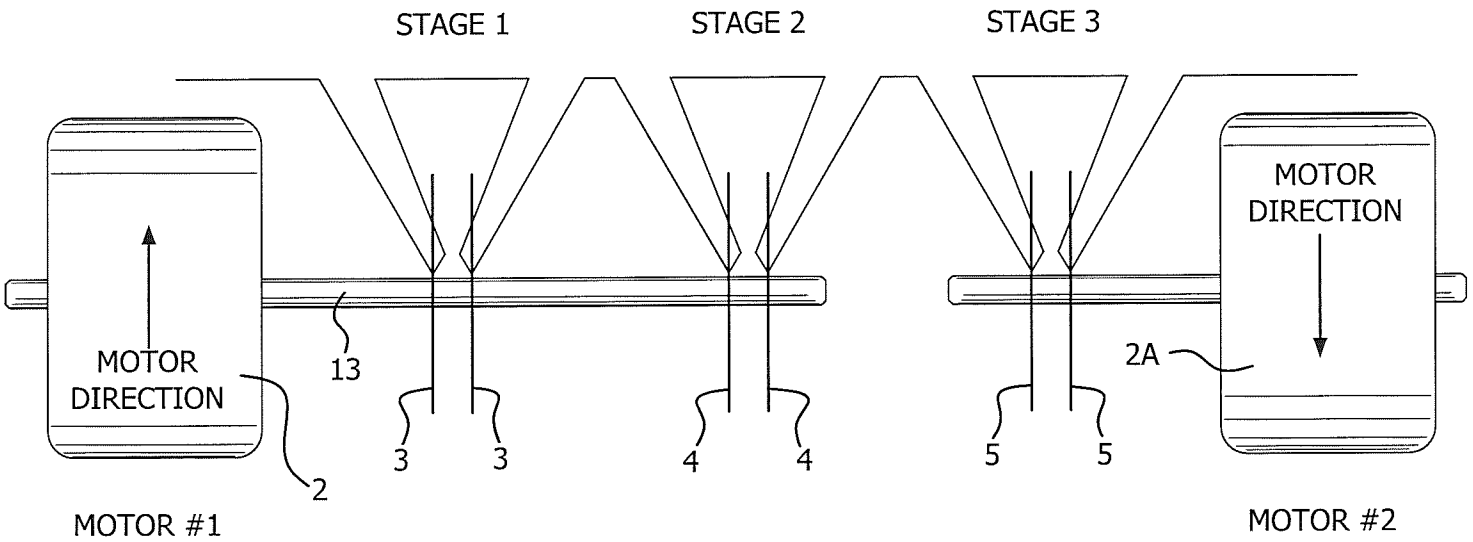
FIG. 12 is a schematic side elevational view showing yet another form of transmission mechanism in accordance with this invention.

FIG. 12 illustrates a further form of electrically powered drive structure. As illustrated, motor 2 drives shaft 13 to move sharpening members 3,4 in one direction. A second motor 2A rotates shaft 16 in a different direction so that its sharpening members 5 are thereby moved in a direction which differs from pre-sharpening stage sharpening members 3,4. Shafts 13 and 16 could be aligned or could be displaced from each other.

A further variation would be to drive each set of pre-sharpening members on its own shaft with separate motors to drive each stage of sharpening members at its own speed. This would result in three shafts and three motors.

Figure 13:
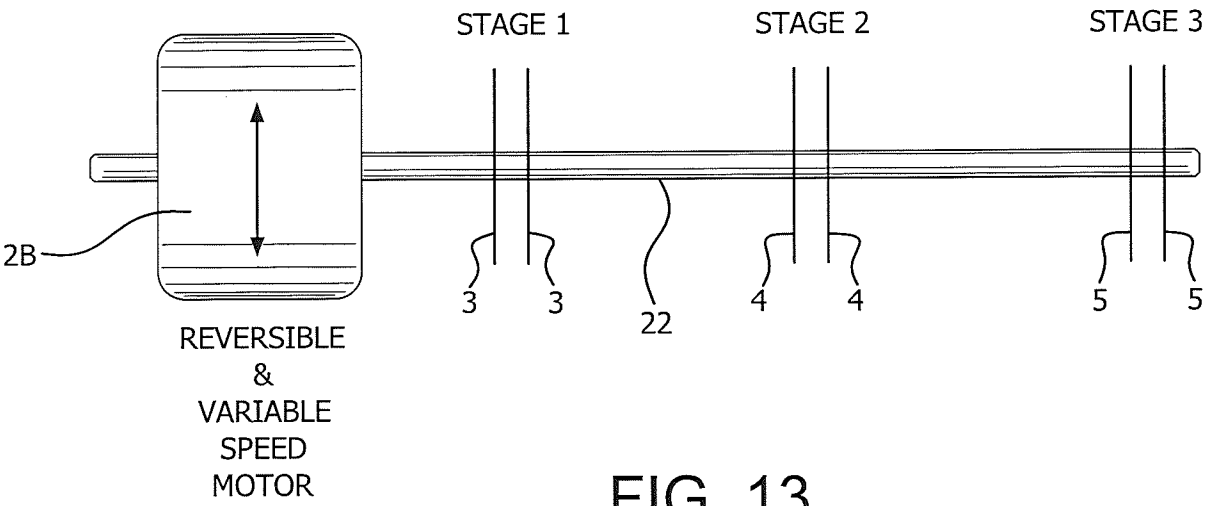
FIG. 13 is a schematic side elevational view showing still yet another embodiment for providing different directions of movement of the sharpening elements in Stages 1-3, of the sharpener of FIGS. 1-3.

FIG. 13 illustrates yet another variation of an electrically powered drive structure. As shown therein, motor 2B is a reversible and variable speed motor. A single shaft 22 is driven by motor 2B. All of the sharpening elements 3,4,5 are mounted on the same shaft 22. When the knife or other cutting instrument is being pre-sharpened in Stage 1, and then in Stage 2, motor 2B would drive shaft 22 in one direction at a selected speed. When the knife or other cutting instrument is in Stage 3, the direction of rotation of shaft 22 would be reversed and the speed could also be changed (preferably increased) so that the final stage cutting members 5,5 are thereby moved in a different direction than the preliminary stage cutting members and may be moved at a different speed.

Figure 15:
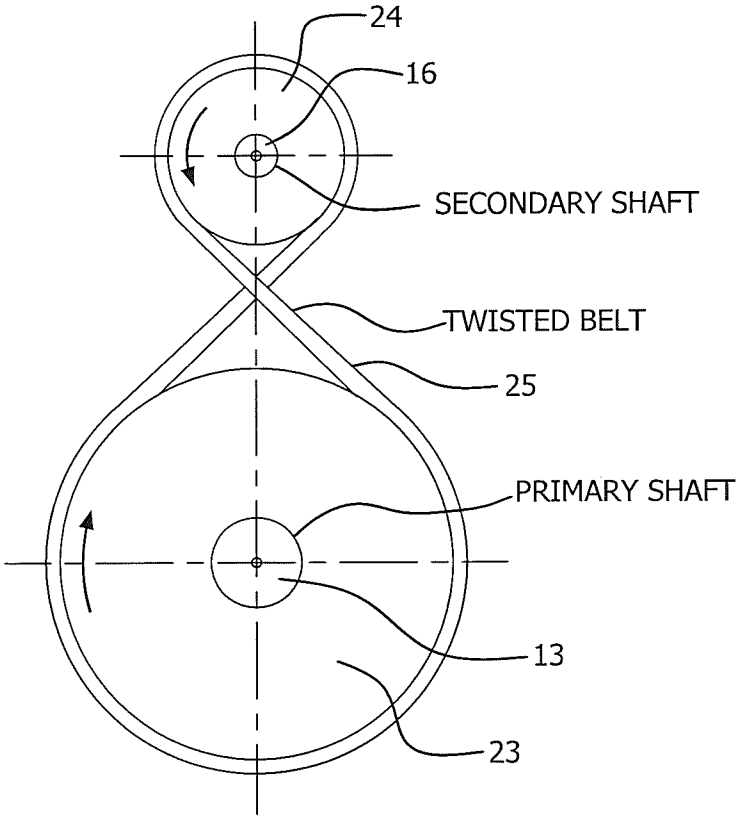
FIGS. 14-15 are schematic views showing the side and the end views of yet another transmission mechanism in accordance with this invention.
Figure 14:
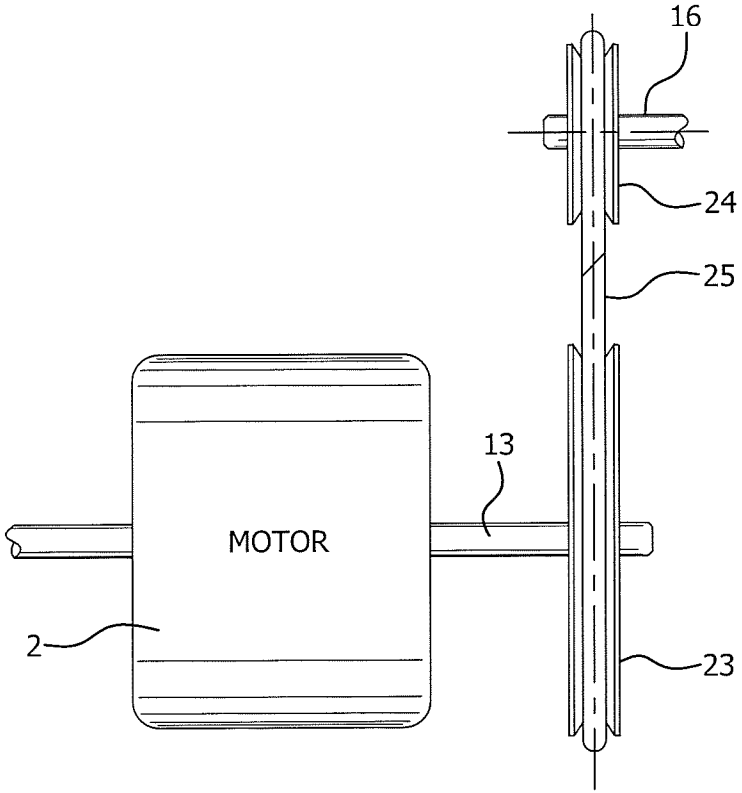

FIGS. 14-15 illustrate yet another form of electrically powered drive structure. As illustrated motor 2 drives pre-sharpening shaft 13. The secondary or Stage 3, shaft 16 is mounted parallel to and displaced from primary shaft 13. A primary pulley 23 is mounted on shaft 13 and a secondary pulley 24 is mounted on shaft 16. The pulleys are interconnected by twisted belt 25. Thus, when motor 2 rotates shaft 13 in one direction, the transmission mechanism which comprises the pulleys and belt causes shaft 16 to rotate in the opposite direction. The shafts 13 and 16 have the respective sharpening members mounted on those shafts.

The various alternative forms of electrically powered drive structure can provide the higher abrasive speed and different direction of rotation in the final stage. Thus, such alternative designs can use two motors (FIG. 12) that drive their shafts in different directions at different speeds or use pulleys with a twisted belt coupling (FIG. 14) to couple the power of the one motor shaft with a second shaft that will turn in the opposite direction. Alternative designs can have a reversible motor with adjustable speed control (FIG. 13) to obtain the optimum speed and correct direction, or a motor with twisted belt transmission mechanism.

It is also possible to practice the invention with a sharpener having only two stages. The stages of such two stage configuration would use the technology similar to Stage 2, and Stage 3, of the larger (3, stage) sharpener described above.

The two stage configuration would require more time to sharpen a very dull chipped knife. An intermediate sized grit in the first stage would likely be used in the two stage sharpener and consequently it will take longer to remove large chips along the edge. Because of the lower quality of the edge in this first stage it will take longer to finish in the new third stage.

FIGS. 2-3 illustrate the sharpener to have a set of two sharpening members or disks in each of its stages. In practice, a knife would be placed against one of the disks to sharpen one side or facet of the edge and then placed against the other disk of that stage to sharpen the other side of the edge. The invention can be practiced where both sides are sharpened simultaneously. For example, instead of having two separate and distinct sharpening members, such as shown in FIGS. 2-3 where one facet is sharpened against one sharpening member and the other facet is sharpened against the other sharpening member, interdigitating abrasive wheels could be used to sharpen both facets simultaneously. The blade edge would be placed at the intersection of the interdigitated sharpening members, with or without guide structure, so that both facets are simultaneously in contact with the sharpening members. Such simultaneous sharpening can be done in any or all of the stages.

The present invention broadly involves providing an electrically powered sharpener for sharpening the cutting edge of a cutting instrument. In particular, the cutting edge is made of a hard and brittle material, such as a ceramic knife. The sharpener has at least one pre-sharpening stage and at least one final or finishing stage. At least one abrasive surfaced pre-sharpening stage sharpening member is in the pre-sharpening stage and at least one abrasive surfaced final stage sharpening member is in the final stage. Preferably, a guiding structure is provided in each pre-sharpening stage and final stage to guide and stabilize the cutting instrument blade and align and position the cutting instrument edge precisely at a defined location on the abrasive surface of the respective sharpening member. Electrically powered drive structure moves the pre-sharpening stage sharpening member in one direction and moves the final stage sharpening member in a second direction which differs from the first direction.

Some of the features of the sharpener and its method of use include the following.

A sharpener for sharpening knives and other ceramic cutting instruments, comprises two or more stages, where one or more stages provide the rough sharpening (pre-sharpening) and subsequently one or more stages provide the finishing of the edge.

a. The abrasive members in the pre-sharpening stage(s) move in one direction and the abrasive members in the finishing stage(s) move in a different direction.
b. The abrasive members can be shaped as disks, drums, belts, etc.
c. The sharpening mechanism in the pre-sharpening stage(s) sharpen one side of the ceramic knife, or other cutting instrument, on one side at a time.
d. The sharpening mechanism in the pre-sharpening stage(s) could alternatively sharpen both sides of the ceramic knife, or other cutting instrument, at the same time by using interdigitating, abrasive surfaced teeth or wheels.
e. The sharpening mechanism in the finishing stage(s) sharpen one facet of the edge at one time.
f. The abrasive member(s) are in the finishing stage(s) are comprised of flexible materials allowing them to flex and bend.

The abrasive grit sizes for effectively sharpening ceramic knives and other hard and brittle cutting instruments can range as follows:

a. In the pre-sharpening stage(s) the grit size can vary from 600, to 2000. For the most effective sharpening the optimal range is 1200, to 2000.
b. In the finishing stage(s), the grit size can vary from 5, micron to 30, micron. For the most effective finishing, the optimum range is 8, to 15, micron.
c. In the finishing stage(s) the spring force of abrasives in the flexible matrix can vary from 0.6, lb. to 1.24, lbs. For the most effective finishing the spring force range fell within 0.8, to 1.1, lb.

The linear speeds of the abrasives in the sharpener, vis-a-vis the edge of the ceramic knife, is critical for successfully developing the best quality sharp edge.

a. The linear speed of the abrasive in the pre-sharpening stage(s) may range from 500, to 3000, ft./min. For the most effective pre-sharpening the linear speed should be 600, to 1000, ft./min.
b. The linear speed of the abrasive in the finishing stage(s) may range from 700 ft/min. to 3500, ft/min. For the most effective finishing, the range should be 1000, to 1500 ft/min.

The abrasive members in the sharpener are motor driven to achieve optimum speeds and direction for the pre-sharpening and finishing stage(s). Since the pre-sharpening stage(s) move in at a different speed and direction than the finishing stage(s), the speed variation and change in direction can be accomplished by:

a. Transmission mechanism
   The transmission mechanism can be a gear train. Helical gears are much more effective than "straight cut" gears.
   The transmission mechanism can be a twisted belt.
   The transmission mechanism can comprise at least one pulley.
b. Using two different motors for separately driving the pre-sharpening and lapping stage(s).
c. Using a reversible motor with a speed control mechanism to separately drive the pre-sharpening and lapping stages.

Some preferred characteristics of the finishing stage(s) are that its sharpening member has an active area for contacting the cutting instrument. The sharpening member is flexible in the active area to allow the disk to flex and bend under repeated loading to provide a gentler impact of the abrasive particles against the cutting instrument edge facets and consequently the facets would be eroded and thinned with substantially less damage to the edge itself and the final edge thickness can be reduced to optimal sharpness. The finishing stage sharpening member is an abrasive loaded polymeric resin system that has a recovery in the range of 61% to 64% and a remaining depression of 145-150, divisions as measured on a Wilson Rockwell test using a ⅞, " diameter steel ball with a minor weight of 10, kilograms and a major weight of 60, kilograms. The sharpening member is an abrasive loaded polymeric resin system, loaded 50%-70% by weight with abrasive material particles having a grit size of 5-30, microns, preferably 8-15, microns. The preferred abrasive is tungsten carbide, silicon carbide, boron carbide or diamonds. The abrasive material is harder than the material of the blade to be sharpened, e.g. ceramic.

As would be apparent to one of ordinary skill in the art other variations are possible within the teachings of this invention.

What is claimed is:

1. An electrically powered sharpener for sharpening the cutting edge of a cutting instrument having a blade with one or more facets which converge toward each other to form the cutting edge at their intersection, said sharpener having at least one pre-sharpening stage, at least one sharpening member having an abrasive surface with abrasive particles in said pre-sharpening stage, a final stage in said sharpener, at least one final stage sharpening member having an abrasive surface with abrasive particles in said final stage, and electrically powered drive structure for moving all of said pre-sharpening stage sharpening members in the same first direction from the edge into the blade to place the edge under compression and for moving all of said final stage sharpening members in a same second direction which differs from said first direction and which moves out of the edge to place the edge under tension.

2. The sharpener of claim 1 wherein said pre-sharpening stage includes a pre-sharpening stage guiding structure for guiding and stabilizing the cutting instrument to align and position the instrument cutting edge precisely at a defined location on said abrasive surface of said pre-sharpening stage sharpening member, and said final stage having a final stage guiding structure for guiding and stabilizing the instrument cutting edge to align and position the instrument cutting edge precisely at a defined location on said abrasive surface of said final stage sharpening member.

3. The sharpener of claim 1 wherein said at least one pre-sharpening stage sharpening member is mounted on a rotatable pre-sharpening shaft, said at least one final stage sharpening member being mounted on a final stage sharpening shaft, said pre-sharpening stage shaft and said final stage shaft being displaced from and parallel to each other, and a transmission mechanism interconnecting said pre-sharpening stage shaft to said final stage shaft for changing the direction of rotation of said shafts.

4. The sharpener of claim 3 wherein said transmission mechanism includes a gear train comprising a helical gear on each of said shafts meshing with each other.

5. The sharpener of claim 3 wherein said transmission mechanism is selected from the group consisting of a gear train and a planetary gear mechanism and a twisted belt and pulleys; and a motor rotating one of said shafts.

6. The sharpener of claim 1 wherein each of said at least one pre-sharpening sharpening member is mounted on a motor driven shaft, and said at least one final stage sharpening member is mounted on a separate shaft driven by a further motor.

7. The sharpener of claim 1 wherein said at least one pre-sharpening sharpening member is mounted on a rotatable shaft and said at least one final stage sharpening member also being mounted on said shaft, and a reversible and variable speed motor driving said shaft to selectively change the direction of rotation of said shaft and to permit said pre-sharpening sharpening member to rotate at a different speed than said final stage sharpening member.

8. The sharpener of claim 1 wherein there are two of said pre-sharpening stages comprising Stage 1 and Stage 2, at least one sharpening member in each of said Stage 1 and Stage 2, and all of said sharpening members in Stage 1 and Stage 2 being mounted on a single shaft, and said final stage being Stage 3.

9. The sharpener of claim 8 wherein the abrasive particles on said abrasive surface on said pre-sharpening members in each of Stage 1 and Stage 2 have a grit size of 600-2000, the abrasive particles on said sharpening member of Stage 3 having a grit size of 5 microns to 30 microns and also having a spring tension of 0.6 lb to 1.24 lbs.

10. The sharpener of claim 9 wherein said abrasive particles of said pre-sharpening sharpening members have a grit size of 1200-2000, said abrasive particles of said Stage 3 sharpening member having a grit size of 8 to 15 microns and also having a spring tension of 0.8 to 1.1 lbs.

11. The sharpener of claim 8 wherein Stage 1 has a set of two sharpening members in the form of rotatable disks, said Stage 2 sharpening members being a set of two rotatable disks, and said Stage 3 sharpening members being a set of two rotatable disks.

12. The sharpener of claim 11 wherein an inverted U-shaped spring guide is mounted between each set of said disks, said spring guide having a spring arm located at each of said guiding structures for maintaining a cutting edge inserted between said spring arm and said guiding structure disposed against a planar surface of said guiding structure, each of said pre-sharpening sharpening members having an abrasive surface on a rigid disk, and each of said final stage sharpening members being formed by abrasive particles embedded within a soft medium which is capable of flexing and bending.

13. The sharpener of claim 1 wherein said at least one pre-sharpening stage sharpening member is in the form of an abrasive surface on a rigid backing, and said at least one final stage sharpening member being in the form of abrasive particles embedded in a soft medium capable of flexing and bending.

14. The sharpener of claim 1 wherein there is only a single pre-sharpening stage and only a single final stage.

15. The sharpener of claim 1 wherein said final stage sharpening member has an active area for contacting the cutting instrument, said sharpening member being flexible in said active area to allow said sharpening member to flex and bend under repeated loading to provide a gentler impact of the abrasive particles against the cutting instrument edge facets and consequently the facets would be eroded and thinned with substantially less damage to the edge itself and the final edge thickness can be reduced to optimal sharpness.

16. The sharpener of claim 15 wherein said final stage sharpening member is an abrasive loaded polymeric resin system that has a recovery in the range of 61% to 64% and a remaining depression of 145-150 divisions as measured on a Wilson Rockwell test using a ⅞" diameter steel ball with a minor weight of 10 kilograms and a major weight of 60 kilograms.

17. The sharpener of claim 15 wherein said final stage sharpening member is an abrasive loaded polymeric resin system, said resin system being loaded 50%-70% by weight with abrasive material particles having a grit size of 5 to 30 microns.

18. The sharpener of claim 17 where said final stage abrasive is made of a material harder than ceramic.

19. The sharpener of claim 17 where said final stage abrasive is made from a material selected from the group consisting of tungsten carbide silicon carbide, or boron carbide or diamonds.

20. A method of sharpening the hard and brittle cutting edge of a cutting instrument having a blade with one or more facets which converge toward each other to form the cutting edge at their intersection, comprising providing a sharpener having at least one pre-sharpening stage and at least one final sharpening stage with at least one abrasive surfaced pre-sharpening member with abrasive particles in the pre-sharpening stage and at least one abrasive surfaced final stage sharpening member with abrasive particles in the final stage, placing the hard and brittle cutting edge against the abrasive surface of the pre-sharpening member, moving all of the pre-sharpening members in a same first direction from the edge into the blade to place the edge under compression to pre-sharpen the cutting edge, removing the cutting edge from the first stage, placing the cutting edge against the abrasive surface of the final stage sharpening member, and moving all of the final stage sharpening members in a same second direction which differs from the first direction and which moves out of the edge to place the edge under tension to sharpen the cutting edge.

21. The method of claim 20 wherein the cutting edge is inserted into the pre-sharpening stage by placing the cutting edge against guiding structure for guiding and stabilizing the cutting edge and positioning the cutting edge precisely at a defined location on the abrasive surface of the pre-sharpening stage sharpening member, and the cutting edge is placed in the final stage by placing the cutting edge against final stage guiding structure for guiding and stabilizing the cutting edge to align and position the cutting edge precisely at a defined location on the abrasive surface of the final stage sharpening member.

22. The method of claim 20 wherein the pre-sharpening member is rotated in the first direction, and the final stage sharpening member being rotated in the second direction which is opposite the first direction.

23. The method of claim 20 wherein the angle of approach of abrasive particles on the pre-sharpening sharpening member is into the cutting edge is between 10 degrees and 90 degrees, and the angle of departure of abrasive particles in the final stage is between 10 degrees and 90 degrees.

24. The method of claim 20 wherein each pre-sharpening stage has a set of two pre-sharpening members and the cutting edge is sharpened in the pre-sharpening stage one side at a time.

25. The method of claim 20 wherein both sides of the cutting edge are simultaneously sharpened.

26. The method of claim 20 wherein the final stage sharpening member is moved at a linear speed which is greater than the linear speed of the at least one pre-sharpening sharpening member.

27. The method of claim 26 wherein the linear speed of the abrasive in the pre-sharpening stage is from 500 to 3000 ft./min., the linear speed of the abrasive particles on the final stage sharpening member being from 700 ft./min. to 3500 ft./min., the abrasive particles on the pre-sharpening cutting member having a grit size of 600 to 2000 and the abrasive particles in the final stage sharpening member having a grit size of 5 micron to 30 micron and having a spring force of 0.6 lb. to 1.24 lb.

28. The method of claim 20 wherein the hard and brittle cutting edge is made of ceramic material.

29. The method of claim 20 wherein the abrasive particles in the pre-sharpening sharpening member move in a direction into the cutting edge and then across the supporting edge facet, and the abrasive particles in the final stage sharpening member move in an opposite direction first across the supporting edge facet and then out of the edge itself.

30. The method of claim 20 wherein the sharpening of the hard and brittle cutting edge is done in a dry sharpening environment which is not dependent on liquid for cooling, lubrication or dispersion of abrasives when sharpening.

31. The method of claim 20 wherein the pre-sharpening stage includes a Stage 1 and a Stage 2 and the final sharpening stage is a Stage 3, removing major nicks from the edge during Stage 1, refining the edge during Stage 2 and finishing/polishing/lapping the edge in Stage 3.

32. The sharpener of claim 31 wherein the sharpening members in each of Stage 1 and Stage 2 and Stage 3 comprises a set of disks urged apart and toward a guide surface by a spring, the sharpening members in Stage 2 having abrasive particles of a grit size finer than the abrasive particles in Stage 1 and having a lower spring force than the spring force in Stage 1, and the sharpening members in Stage 3 moving at a higher speed than the sharpening members in Stage 1 and in Stage 2.

33. The method of claim 20 wherein there is only a single pre-sharpening stage and a single final stage.

34. The method of claim 20 wherein all of the at least one sharpening member in each pre-sharpening stage and in each final stage are coaxially mounted in its respective stage.

35. The sharperner of claim 1 wherein all of said at least one sharpening member in each pre-sharpening stage being coaxially mounted in its pre-sharpening stage and all of said at least one final stage sharpening member being coaxially mounted in said final stage.

* * * * *